US009132560B2

(12) United States Patent
Shimizu et al.

(10) Patent No.: US 9,132,560 B2
(45) **Date of Patent: *Sep. 15, 2015**

(54) HAIR REMOVER

(75) Inventors: Hiroaki Shimizu, Shiga (JP); Tetsuro Hashiguchi, Shiga (JP)

(73) Assignee: PANASONIC INTELLECTUAL PROPERTY MANAGEMENT CO., LTD., Osaka-shi (JP)

( * ) Notice: Subject to any disclaimer, the term of this patent is extended or adjusted under 35 U.S.C. 154(b) by 223 days.

This patent is subject to a terminal disclaimer.

(21) Appl. No.: 13/600,542

(22) Filed: Aug. 31, 2012

(65) Prior Publication Data

US 2013/0081277 A1 Apr. 4, 2013

(30) Foreign Application Priority Data

Sep. 30, 2011 (JP) ..... 2011-217345

(51) Int. Cl.
*B26B 19/02* (2006.01)
*B26B 19/04* (2006.01)
*B26B 19/06* (2006.01)

(52) U.S. Cl.
CPC ..... *B26B 19/048* (2013.01); *B26B 19/02* (2013.01); *B26B 19/063* (2013.01)

(58) Field of Classification Search
CPC ..... B26B 19/00; B26B 19/06; B26B 19/063; B26B 19/048; B26B 19/02
USPC ..... 30/43.1, 43.3, 54, 58, 60, 61, 63, 71, 30/526–541, 198, 199, 43.7–43.92
See application file for complete search history.

(56) References Cited

U.S. PATENT DOCUMENTS

| | | | | |
|---|---|---|---|---|
| 511,966 | A * | 1/1894 | Olsen | 30/199 |
| 831,259 | A * | 9/1906 | Bingler | 30/531 |
| 1,427,587 | A * | 8/1922 | Fugitt | 30/199 |
| 1,552,234 | A * | 9/1925 | Roebuck | 30/529 |

(Continued)

FOREIGN PATENT DOCUMENTS

| | | | |
|---|---|---|---|
| AU | 2011202738 | A1 | 6/2011 |
| DE | 9014307.8 | U1 | 4/1991 |

(Continued)

OTHER PUBLICATIONS

Office Action dated Oct. 21, 2013, issued for the corresponding Russian patent application No. 2012137877/12 and English translation thereof.

(Continued)

*Primary Examiner* — Jason Daniel Prone
(74) *Attorney, Agent, or Firm* — Locke Lord LLP

(57) ABSTRACT

A hair remover includes a main unit having a gripper, a head unit having a blade, and a drive unit for driving the blade. One end of the main unit has an extension portion extending in an extension direction. The direction in the head unit along the hair removing direction of the blade is defined as a first direction. A second direction in the head unit is perpendicular to the first direction. The hair remover also includes a rotating mechanical section having a rotation center, the axis of which is perpendicular to the extension direction, enabling the head unit to rotate around the rotation center with respect to the main unit, and thereby switching between a state where the second direction of the head unit is parallel to the extension direction and a state where the second direction of the head unit is perpendicular to the extension direction.

10 Claims, 14 Drawing Sheets

(56) References Cited

U.S. PATENT DOCUMENTS

| | | | | | |
|---|---|---|---|---|---|
| 1,997,096 | A | * | 4/1935 | Andis | 30/199 |
| 2,113,772 | A | * | 4/1938 | Rothschild et al. | 30/48 |
| 2,162,388 | A | * | 6/1939 | Rockwell | 30/531 |
| 2,484,610 | A | * | 10/1949 | Cromonic | 30/210 |
| 3,797,109 | A | * | 3/1974 | Yamada et al. | 30/531 |
| 3,964,160 | A | * | 6/1976 | Gordon | 30/531 |
| 4,083,103 | A | * | 4/1978 | Estandian | 30/531 |
| 4,332,321 | A | * | 6/1982 | Wratschko | 30/536 |
| 4,837,930 | A | * | 6/1989 | Righi | 30/535 |
| 4,841,635 | A | * | 6/1989 | Maurizi et al. | 30/535 |
| 4,977,669 | A | * | 12/1990 | Clifford | 30/539 |
| 5,010,645 | A | * | 4/1991 | Furukawa | 30/47 |
| 5,070,614 | A | * | 12/1991 | Hardin et al. | 30/527 |
| 5,093,991 | A | * | 3/1992 | Hendrickson | 30/531 |
| 5,165,172 | A | * | 11/1992 | Weinrauch | 30/199 |
| 5,206,994 | A | * | 5/1993 | Lin | 30/536 |
| 5,269,062 | A | * | 12/1993 | Dallaire et al. | 30/539 |
| 5,465,488 | A | * | 11/1995 | Yaw et al. | 30/535 |
| 5,526,568 | A | * | 6/1996 | Copelan | 30/531 |
| 5,622,195 | A | * | 4/1997 | Lee | 30/535 |
| 5,784,785 | A | * | 7/1998 | Polites | 30/528 |
| 6,151,785 | A | * | 11/2000 | Morris | 30/206 |
| 6,502,312 | B2 | * | 1/2003 | Beutel et al. | 30/216 |
| 6,536,116 | B2 | * | 3/2003 | Fung | 30/199 |
| 6,684,507 | B2 | * | 2/2004 | Lau et al. | 30/216 |
| 7,140,116 | B2 | * | 11/2006 | Coffin | 30/531 |
| 7,251,896 | B2 | * | 8/2007 | Khubani | 30/199 |
| 7,503,118 | B2 | * | 3/2009 | Oh | 30/43.1 |
| 7,721,451 | B2 | * | 5/2010 | Psimadas et al. | 30/527 |
| 7,805,846 | B2 | * | 10/2010 | Leventhal et al. | 30/526 |
| 8,127,453 | B2 | * | 3/2012 | Haczek et al. | 30/527 |
| 8,359,755 | B1 | * | 1/2013 | Laube | 30/199 |
| 8,595,938 | B2 | * | 12/2013 | Bodet | 30/527 |
| 2006/0053632 | A1 | | 3/2006 | Khubani | |
| 2008/0155834 | A1 | * | 7/2008 | Li et al. | 30/199 |
| 2008/0295340 | A1 | * | 12/2008 | Carlucci et al. | 30/199 |
| 2008/0301948 | A1 | * | 12/2008 | Kostner et al. | 30/527 |
| 2009/0056148 | A1 | * | 3/2009 | Royle | 30/277.4 |
| 2011/0203112 | A1 | * | 8/2011 | Lax | 30/541 |
| 2011/0277326 | A1 | * | 11/2011 | Bodet | 30/527 |
| 2012/0291295 | A1 | * | 11/2012 | Braun | 30/531 |
| 2013/0081278 | A1 | * | 4/2013 | Shimizu et al. | 30/45 |
| 2013/0091709 | A1 | * | 4/2013 | Shimizu et al. | 30/47 |
| 2013/0247394 | A1 | * | 9/2013 | Reid et al. | 30/532 |

FOREIGN PATENT DOCUMENTS

| | | | | |
|---|---|---|---|---|
| EP | 1972417 | A1 | | 9/2008 |
| EP | 1972417 | B1 | | 9/2008 |
| GB | 2383970 | A | * | 7/2003 |
| JP | S57-31886 | A | | 2/1982 |
| JP | 2002-369979 | A | | 12/2002 |
| JP | 2007-519423 | A | | 7/2007 |
| JP | 2008-229263 | A | | 10/2008 |

OTHER PUBLICATIONS

Extended European Search Report dated Jan. 23, 2013, issued for the counterpart European Patent Application No. 12180436.3.

* cited by examiner

HAIR REMOVER

CROSS REFERENCE TO RELATED APPLICATIONS

This application is related to co-pending application: "HAIR REMOVER" filed even date herewith in the names of Hiroaki Shimizu and Tetsuro Hashiguchi, which claims priority to Japanese Application No. 2011-217344 filed Sep. 30, 2011; the above-identified application is assigned to the assignee of the present application and is incorporated by reference herein.

BACKGROUND OF THE INVENTION

1. Field of the Invention

The invention relates generally to hair removers and, more particularly, to a hair remover which cuts body hair by means of driving a blade.

2. Description of the Related Art

There has been a hair remover comprising a comb-shaped fixed blade and a comb-shaped movable blade. This kind of hair remover mainly comprises a head unit having the fixed blade and the movable blade, and a main unit provided in one end of its gripper with an extension portion. The head unit is located in the tip of the extension portion. Then, the head unit in the hair remover contacts with a biological surface on which body hair is sprouted, and the body hair is introduced between the fixed and movable blades. Then, the introduced body hair is sheared (cut off) with the fixed and movable blades, and thereby the body hair on the biological surface is removed. As such a hair remover, for instance, Japanese Patent Application Laid-Open No. 2002-369979 discloses that comb-shaped fixed and movable blades are arranged in parallel with an extension direction of the extension portion, and then Japanese Patent Application Laid-Open No. 2008-229263 discloses that comb-shaped fixed and movable blades are arranged in a direction perpendicular to an extension direction of the extension portion.

Incidentally, in this kind of hair remover, when cutting off body hair, the head unit (the fixed and movable blades) contacts with the biological surface in a direction perpendicular to a sprouting direction of the body hair, and then is moved along the sprouting direction, and thereby the body hair is introduced between these blades more easily.

However, the conventional hair removers described in the above documents and the like can remove body hair only in one or the other of a position where a direction of the head unit is in parallel with the extension direction and a position where the direction of the head unit is perpendicular to the extension direction. That is, when body hair is removed by the conventional hair removers, a hair removing direction in which the head unit is moved with respect to the biological surface is always unchanged with respect to the main unit. For this reason, when removing hair growing on an area having irregularities around, such as a biological surface of a base of arm or leg, the main unit or hand grasping the main unit interferes in the irregularities, and thereby the body hair is not easily introduced between the fixed and movable blades, and there is a possibility that hair growing on such an area is insufficiently shaved.

SUMMARY OF THE INVENTION

It is an object of the present invention to provide a hair remover, which can reduce the possibility that body hair is insufficiently shaved due to the interference in a body associated with a position limitation of a head unit with respect to a main unit.

A hair remover of the present invention comprises a main unit having a gripper, a head unit having a blade for removing hair, and a drive unit for driving said blade. Said main unit is provided in one end with an extension portion that supports said head unit. A direction of said extension portion extended from said one end is defined as an extension direction. A direction in said head unit along a hair removing direction of said blade is defined as a first direction of said head unit. A direction in said head unit perpendicular to the first direction is defined as a second direction of said head unit. The hair remover further comprises a rotating mechanical section having a rotation center of which an axis is perpendicular to the extension direction. Said rotating mechanical section enables said head unit to rotate around the rotation center with respect to said main unit, and thereby said rotating mechanical section switches between a state where the second direction of said head unit is parallel to the extension direction and a state where the second direction of said head unit is perpendicular to the extension direction. Said drive unit comprises a driving source and a drive transmission unit that is configured to transfer a driving force of said driving source to said head unit in said states.

In such a configuration, the hair remover can remove body hair, in a position where it is not easy to interfere in a body, by means of changing a direction of said head unit (a cutting width) with respect to said main unit. Therefore, the hair remover can reduce the possibility that body hair is insufficiently shaved, and can improve the convenience.

In the hair remover, preferably, said head unit is configured so as to be rotated 360 degrees with respect to said main unit through said rotating mechanical section.

In the hair remover, preferably, said drive transmission unit comprises an output member that outputs the driving force of said driving source to said head unit, and said output member is a face gear that rotates around a center corresponding with the rotation center.

In the hair remover, preferably, said driving source is a motor that is located within said main unit, and said drive transmission unit comprises an output member that outputs a rotation driving force of said motor to said head unit, and said output member is a face gear that has a rotation center of which an axis is perpendicular to an axial direction of a rotation axis of said motor.

BRIEF DESCRIPTION OF THE DRAWINGS

Preferred embodiments of the invention will now be described in further details. Other features and advantages of the present invention will become better understood with regard to the following detailed description and accompanying drawings where.

DETAILED DESCRIPTION OF EXEMPLARY EMBODIMENTS

Each embodiment of the present invention will be explained below referring to Figures.

(Embodiment 1)

Figure 1:
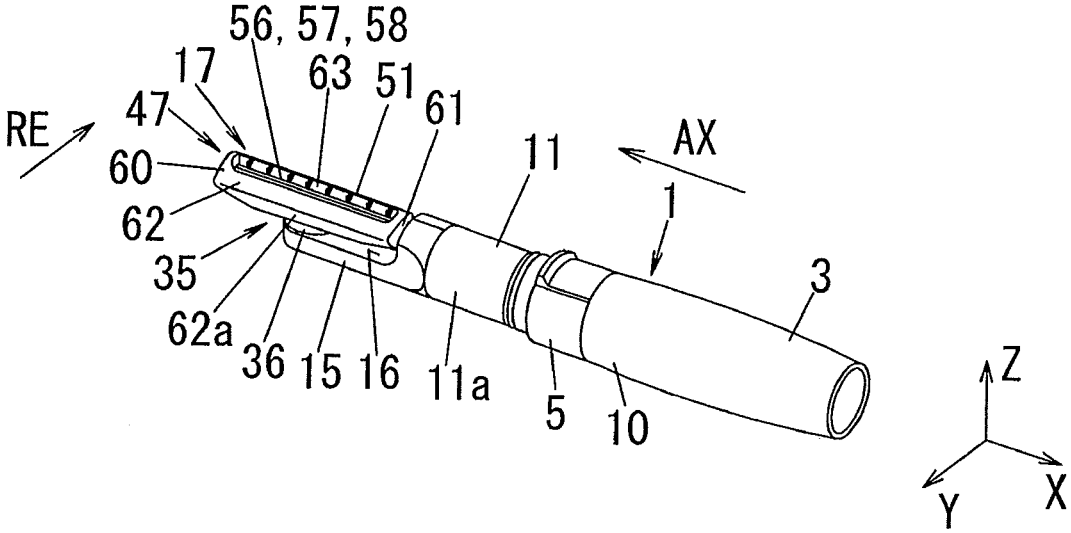
FIG. 1 is an oblique drawing of a hair remover according to an Embodiment 1 of the present invention.

As shown in FIG. 1, a hair remover according to the present embodiment comprises: a main unit 1 having an electric source built in; a head unit 47 having a blade 56 for removing hair; a drive unit 20 (see FIG. 5) for driving head unit 47: and a cap 6 (see FIG. 16) detachably attached to main unit 1 so as to cover head unit 47.

Figure 2:
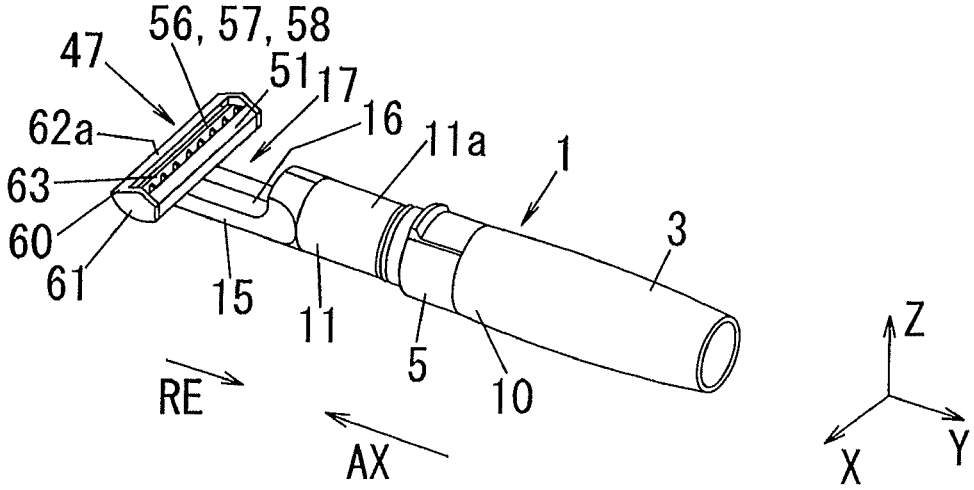
FIG. 2 is an oblique drawing of the hair remover in a state where a direction of a head unit has changed, according to said Embodiment 1 of the present invention.
Figure 4:
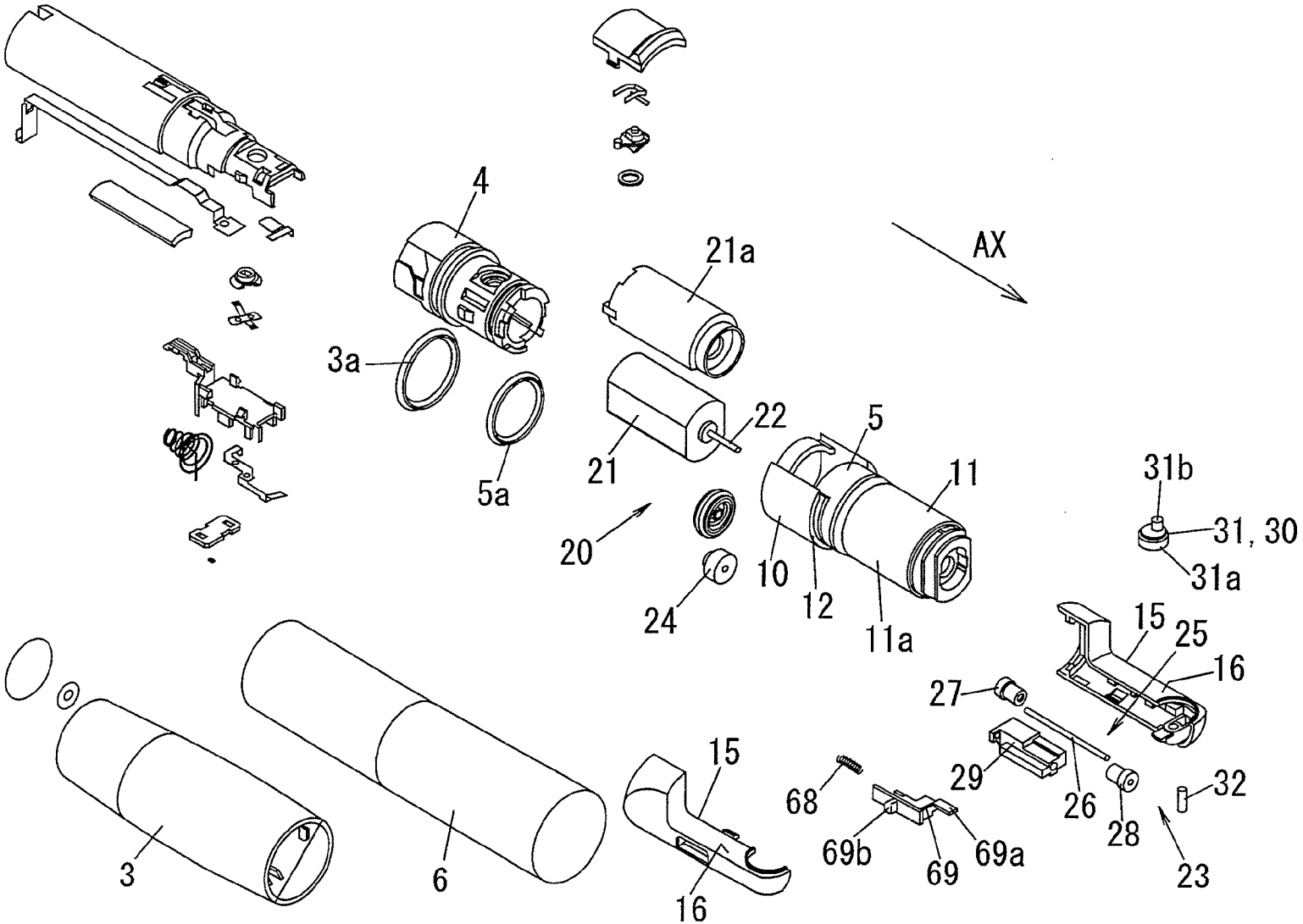
FIG. 4 is an exploded oblique drawing of a main unit and a drive unit in the hair remover according to said Embodiment 1 of the present invention.

As shown in FIG. 4, main unit 1 mainly comprises a battery (not shown) of the electric source, a battery cover 3 for replacing a battery, a housing 5 in which drive unit 20 is stored, and a seal holder 4 for detachably holding battery cover 3 in housing 5. Then, a casing of main unit 1 is formed into a hollow cylinder shape through housing 5 and battery cover 3. The cylinder part comprises a gripper 10 of which an outer periphery can be grasped by a user when using the hair remover, and a small diameter section 11 which has a smaller diameter than gripper 10. As shown in FIGS. 1 and 2, gripper 10 and small diameter section 11 are continuously formed in an axial direction so that axes thereof almost correspond with each other. Then, as shown in FIG. 4, a difference 12 in level is provided between gripper 10 and small diameter section 11. Then, seal holder 4 is attached to housing 5 and battery cover 3 through O-rings 5*a*, 3*a*, and thereby main unit 1 has a waterproof structure in its inside.

Figure 5:
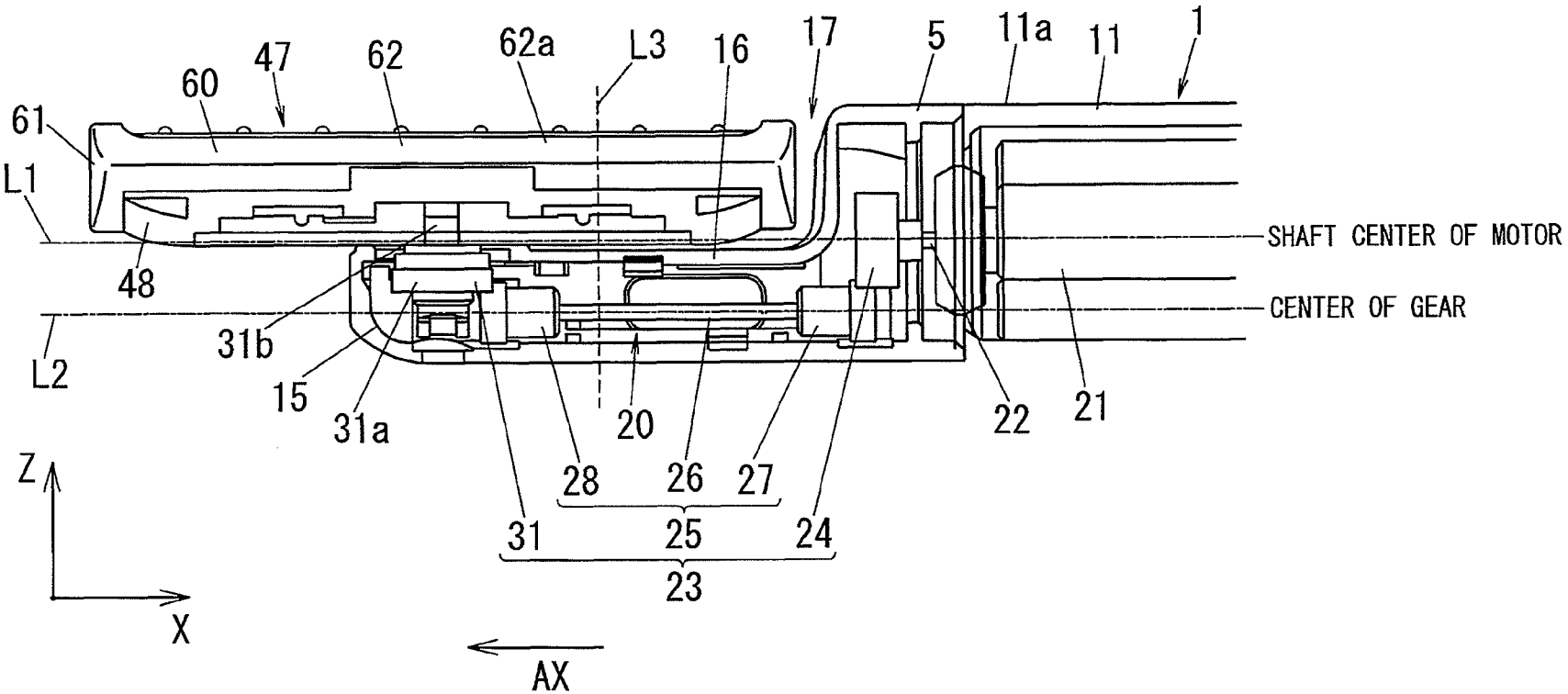
FIG. 5 is a side view of an extension portion and its periphery in the hair remover according to said Embodiment 1 of the present invention, and partially includes a transparent view.

Furthermore, as shown in FIGS. 4 and 5, small diameter section 11 is formed as a part of housing 5, and then a motor housing 21*a* is located in the inside of the small diameter section 11, in a state where a driving source (a motor 21) of drive unit 20 is stored in motor housing 21*a* (see FIG. 4). Then, as shown in FIGS. 1 and 2, main unit 1 is provided in its one end in an axial direction (one end of main unit 1 positioned in the side of small diameter section 11) with an extension portion 15 that extends along the axial direction. Hereinafter, unless otherwise noted, an extension direction of extension portion 15 (the axial direction of main unit 1) will be described as an extension direction Ax.

Figure 6:
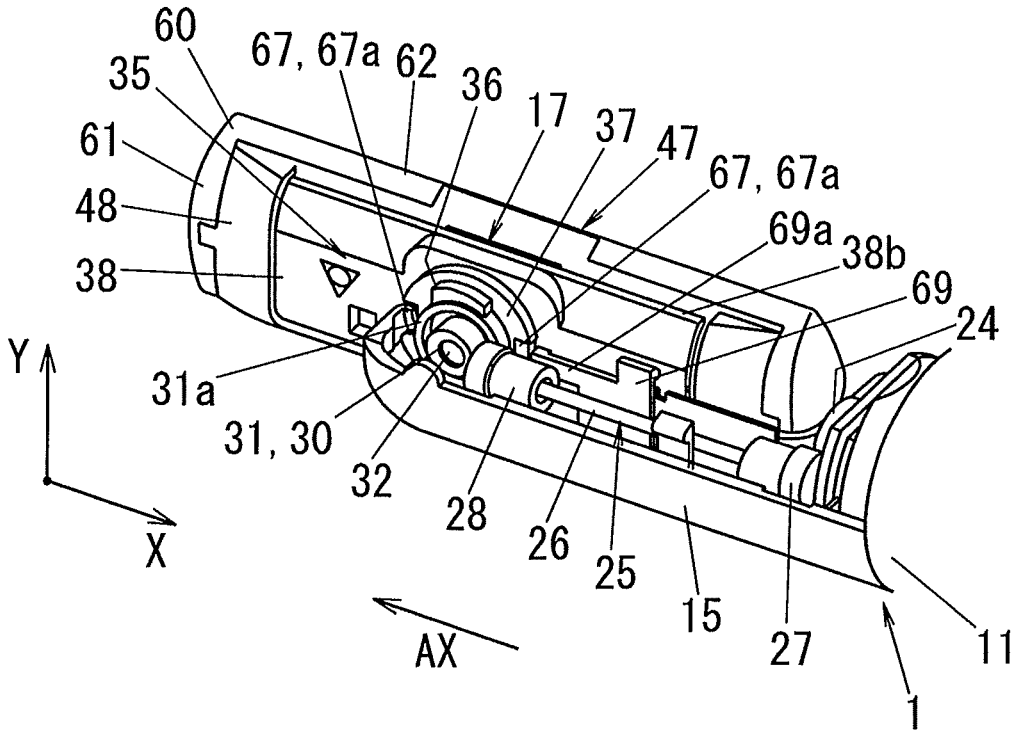
FIG. 6 is an oblique drawing of the extension portion and its periphery in the hair remover according to said Embodiment 1 of the present invention, and partially includes a transparent view.

As shown in FIGS. 4 to 6, drive unit 20 mainly comprises motor 21 of the driving source, and a drive transmission unit 23 that transfers the driving force of motor 21 to head unit 47. Motor 21 is located so that its rotation shaft 22 is parallel to the extension direction Ax and corresponds with an axis of small diameter section 11. Drive transmission unit 23 comprises a pinion gear 24 that is attached to rotation shaft 22, an output member 30 that outputs the driving force into head unit 47, and a gear block 25 that transfers the driving force from pinion gear 24 to output member 30. Pinion gear 24 is stored in one end of small diameter section 11 that is positioned in the side of extension portion 15, and then is attached to rotation shaft 22 so that axes thereof almost correspond with each other.

As shown in FIG. 4, gear block 25 mainly comprises a transmission shaft 26 that is provided in its both ends with gears, and a bush 29 that rotatably holds transmission shaft 26.

As shown in FIGS. 5 and 6, transmission shaft 26 has a shaft center which is parallel to rotation shaft 22 and the extension direction Ax, and a gear (a first gear 27) located in its one end engages with pinion gear 24 and the opposite gear (a second gear 28) engages with output member 30. Then, transmission shaft 26 passes through bush 29, and is stored in extension portion 15 in a state where first gear 27 is located in the side of small diameter section 11. Bush 29 is attached within extension portion 15, and thereby transmission shaft 26 is positioned and is held in extension portion 15.

As shown in FIG. 4, output member 30 mainly comprises a disk-shaped face gear 31, and a shaft member 32 that functions as a rotation center of face gear 31. Shaft member 32 is placed in extension portion 15 so that its shaft center is almost perpendicular to the extension direction Ax, and is fixed through a member forming extension portion 15 of housing 5.

Then, shaft member 32 is inserted to a center of the circle in face gear 31 so that axes thereof almost correspond with each other, and thereby face gear 31 can rotate around the axis of shaft member 32. Therefore, face gear 31 has a rotation center that is almost perpendicular to transmission shaft 26 and rotation shaft 22 of motor 21.

Then, as shown in FIGS. 4 and 5, face gear 31 is provided in one end face of its cylinder with a gear 31*a* that engages with second gear 28, and the driving force is transferred from transmission shaft 26. Then, face gear 31 is provided in the opposite end face with an eccentric section 31*b*. This eccentric section 31*b* decenters the driving force transferred from transmission shaft 26, and transfers to head unit 47.

As described above, drive unit 20 converts the rotation driving force of motor 21 into a force of a perpendicular direction, through output member 30 of drive transmission unit 23, and decenters to output the force into head unit 47. Then, because drive unit 20 comprises gear block 25, the driving force from motor 21 is transferred to head unit 47 at some distance (see an imaginary straight line L2 in the figure) from an imaginary straight line L1 that passes through rotation shaft 22 along the extension direction Ax, toward the outside along a radial direction of rotation shaft 22, as shown in FIG. 5.

For this reason, in the extension direction Ax, extension portion 15 of the hair remover is located at some distance from imaginary straight line L1 that passes through rotation shaft 22, toward the outside along said radial direction. Here, as shown in FIG. 5, extension portion 15 is located so as to be distant from the line L1, toward one direction side of an imaginary straight line L3 extending in said radial direction and intersecting with rotation shaft 22, and thereby a recess 17 is formed in the opposite direction side of said one direction side. Then, head unit 47 is located in recess 17.

Figure 3:
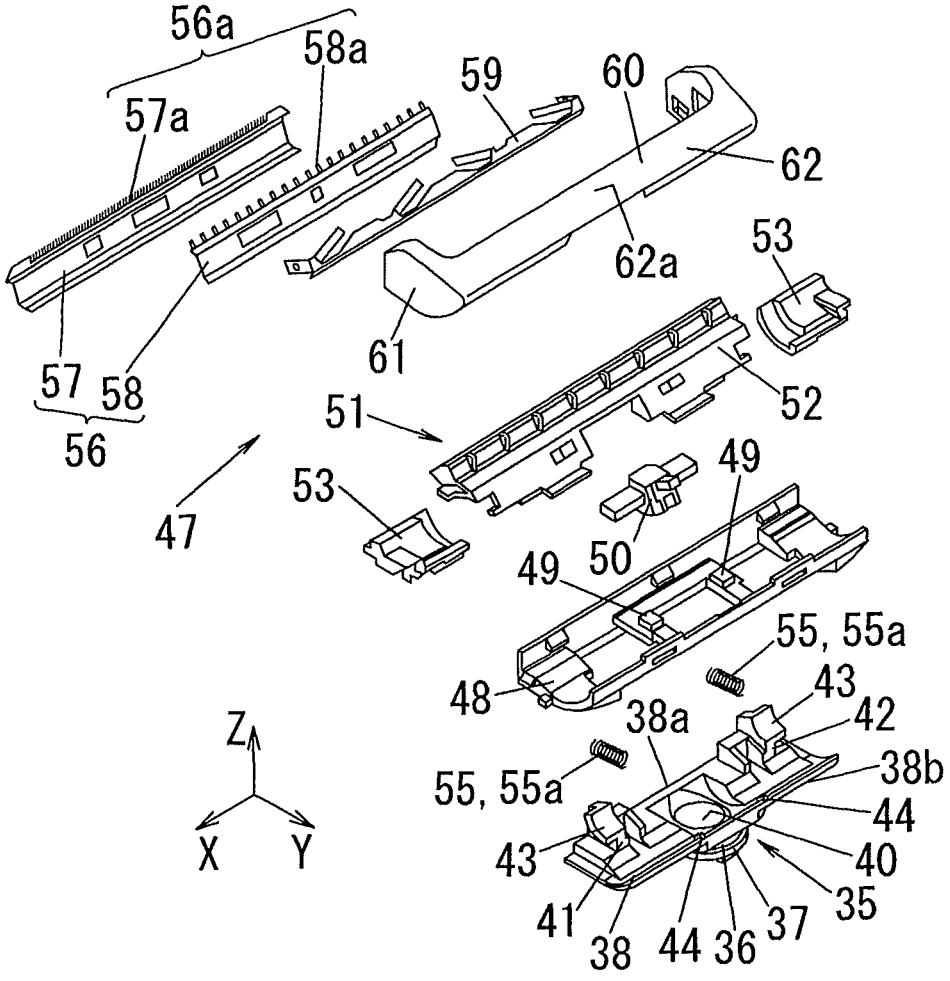
FIG. 3 is an exploded oblique drawing of the head unit and a rotating mechanical section in the hair remover according to said Embodiment 1 of the present invention.
Figure 8:
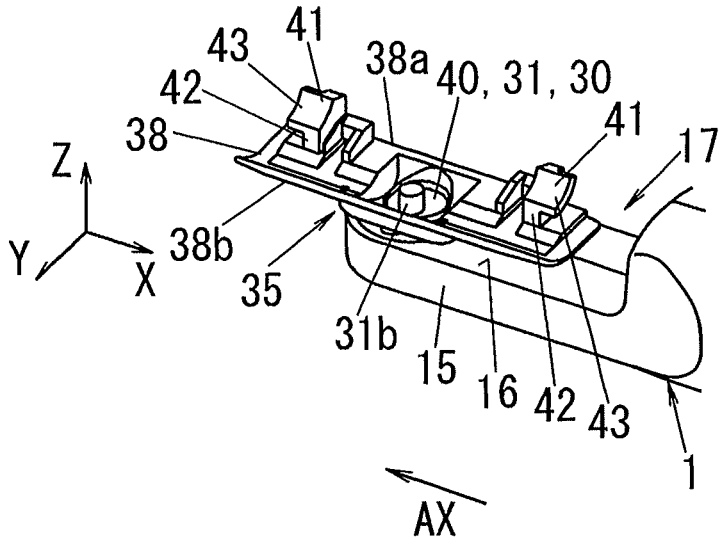
FIG. 8 is an oblique drawing of the rotating mechanical section in a first position in the hair remover according to said Embodiment 1 of the present invention.
Figure 9:
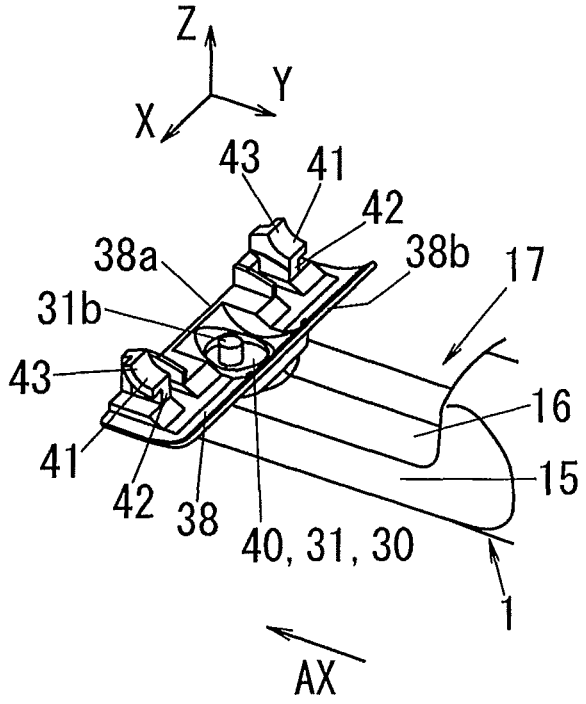
FIG. 9 is an oblique drawing of the rotating mechanical section in a second position in the hair remover according to said Embodiment 1 of the present invention.

Then, as shown in FIGS. 8 and 9, extension portion 15 is provided with a rotating mechanical section 35 that enables head unit 47 to rotate with respect to main unit 1. Then, as shown in FIG. 6, extension portion 15 supports head unit 47 through rotating mechanical section 35. As shown in FIG. 3, rotating mechanical section 35 mainly comprises a rotating part 36 that is rotatably attached to extension portion 15, and a turn plate 38 that is integrally provided in rotating part 36.

Figure 7:
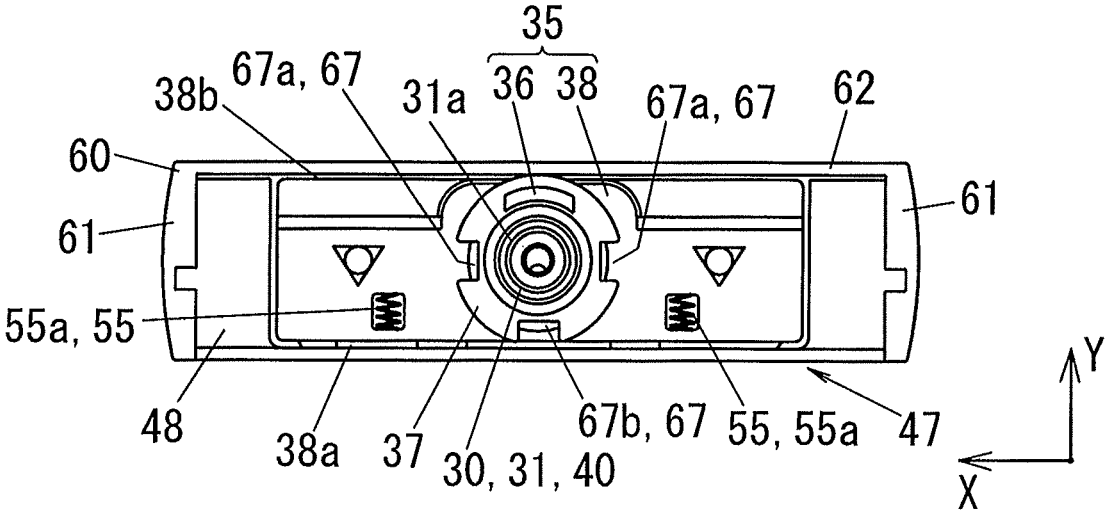
FIG. 7 is a plan view of the head unit and the rotating mechanical section in the hair remover according to said Embodiment 1 of the present invention.

As shown in FIGS. 5 and 6, rotating part 36 is formed into a cylinder shape, and is located so as to pass through a side wall 16 of extension portion 15 positioned in the side of recess 17, and is rotatably attached near a tip of extension portion 15. Then, as shown in FIG. 7, face gear 31 is located in an inner periphery side of rotating part 36 so that axes thereof almost correspond with each other. Then, as shown in FIGS. 6 and 7, one end of the cylinder-shaped rotating part 36 is located in the inside of extension portion 15, and the one end is formed with a flange 37 that projects to the outside along a radial direction of rotating part 36. Flange 37 contacts with an inner surface of side wall 16, and thereby rotating part 36 is retained in extension portion 15. Then, the other end of rotating part 36 is located in the outside of extension portion 15, and is integrally connected to a first plate face of turn plate 38 (a back side of turn plate 38 in FIG. 8).

As shown in FIGS. 7 to 9, turn plate 38 is formed into a sheet and formed into almost a rectangular shape in a planar view, and is provided, in a center of its sheet in a longitudinal direction X, with a through-hole 40 (see FIG. 3) that communicates into the inner periphery of rotating part 36, and is located in recess 17. Then, eccentric section 31*b* of face gear 31 projects to this through-hole 40. That is, through-hole 40 is an output hole formed for outputting the driving force of drive transmission unit 23 from eccentric section 31*b* to head unit 47. Hereinafter, a longitudinal direction and a width direction of turn plate 38 will be described as a longitudinal direction X and a width direction Y, respectively. Also, a direction perpendicular to the plate face is defined will be described as a plate face direction Z.

Then, as shown in FIGS. 8 to 10B, turn plate 38 is provided, in a plate face (a second plate face, and that is, a surface in FIG. 8) located on opposite side of the first plate face, with two supporting platforms 41, 41 that support head unit 47. Each supporting platform 41 projects, from the second plate face, along the plate face direction Z. Then, in the width direction Y, each supporting platform 41 is provided at some distance from a center of the second plate face, toward the side of one long side (a first long side 38*a*).

Then, each supporting platform 41 mainly comprises: a base portion 42 that projects from the second plate face and is formed into a rectangular shape when viewed from the plate face direction Z; and an inclined plate 43 that is integrally provided in a tip of base portion 42 and is formed into a rectangular shape when viewed from the plate face direction Z. In the longitudinal direction X, inclined plate 43 has a longer size than base portion 42. The side surfaces of inclined plate 43 and base portion 42, facing the width direction Y and located near output hole 40, are flush with each other in the plate face direction Z. Meanwhile, in the opposite side surfaces, inclined plate 43 projects in the width direction Y more than base portion 42.

Figure 12A:
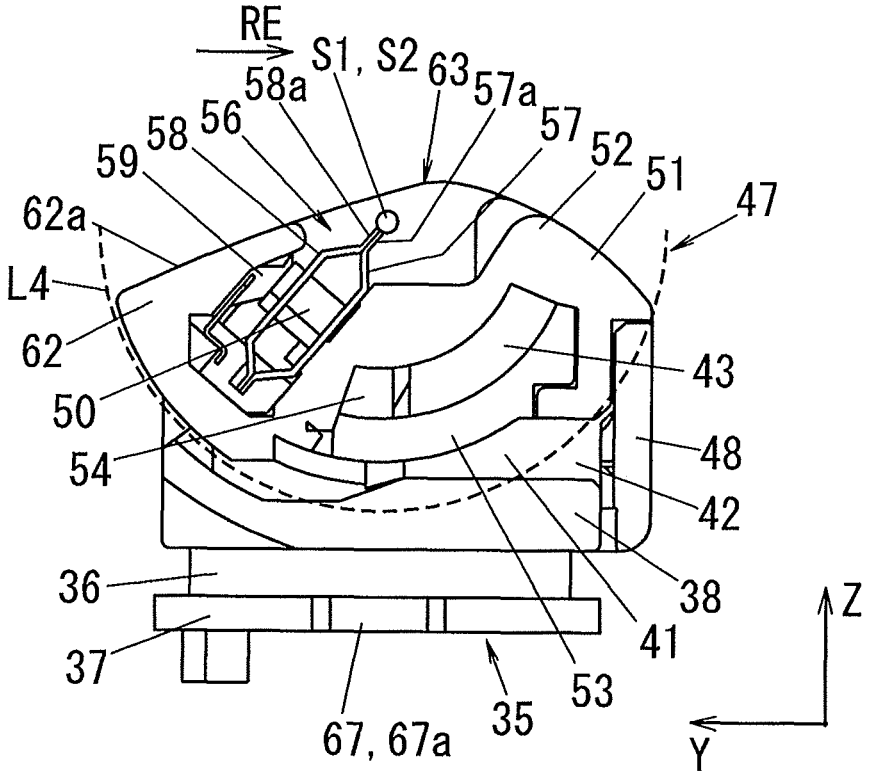
FIG. 12A is a cross-section drawing of the periphery of a supporting platform when the swinging mechanical section is in a natural state, in the hair remover according to said Embodiment 1 of the present invention.
Figure 12B:
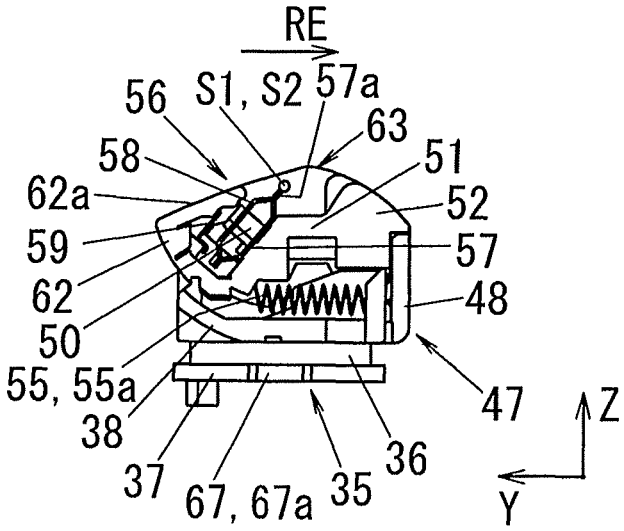
FIG. 12B is a cross-section drawing of the periphery of an elastic body when the swinging mechanical section is in the natural state, in the hair remover according to said Embodiment 1 of the present invention.

Then, inclined plate 43 is formed into an arc shape so as to sag in the side of the second plate face when viewed from the longitudinal direction X. As shown in FIGS. 12A and 12B, a center S1 of the arc is located, at a position distant from inclined plate 43, along the plate face direction Z from a midpoint of the turn plate 38 in the width direction Y. In addition, as can be expected from an imaginary circle L4 having a center almost corresponding with the arc center, the arc intersects with the plate face direction Z and is perpendicular to the longitudinal direction X.

In this way, a projecting tip of each supporting platform 41 has an inclined surface that is inclined so that the side of the first long side 38*a* is distant from the second plate face of turn plate 38. Then, two supporting platforms 41, 41 swingably support head unit 47 along the inclined surfaces (the arc) of inclined plates 43, 43. Head unit 47 has a shaft center S2 of the swing that corresponds with the center S1 of the arc in inclined plate 43 and extends along the longitudinal direction X. However, the shaft center S2 is not a shaft center really existing as a member but an imaginary shaft center, and a shaft member for the shaft center S2 is not located. Then, the shaft center S2 of the swing passes through the rotation center of face gear 31 (the center of output hole 40) when viewed from the plate face direction Z.

Figure 11:
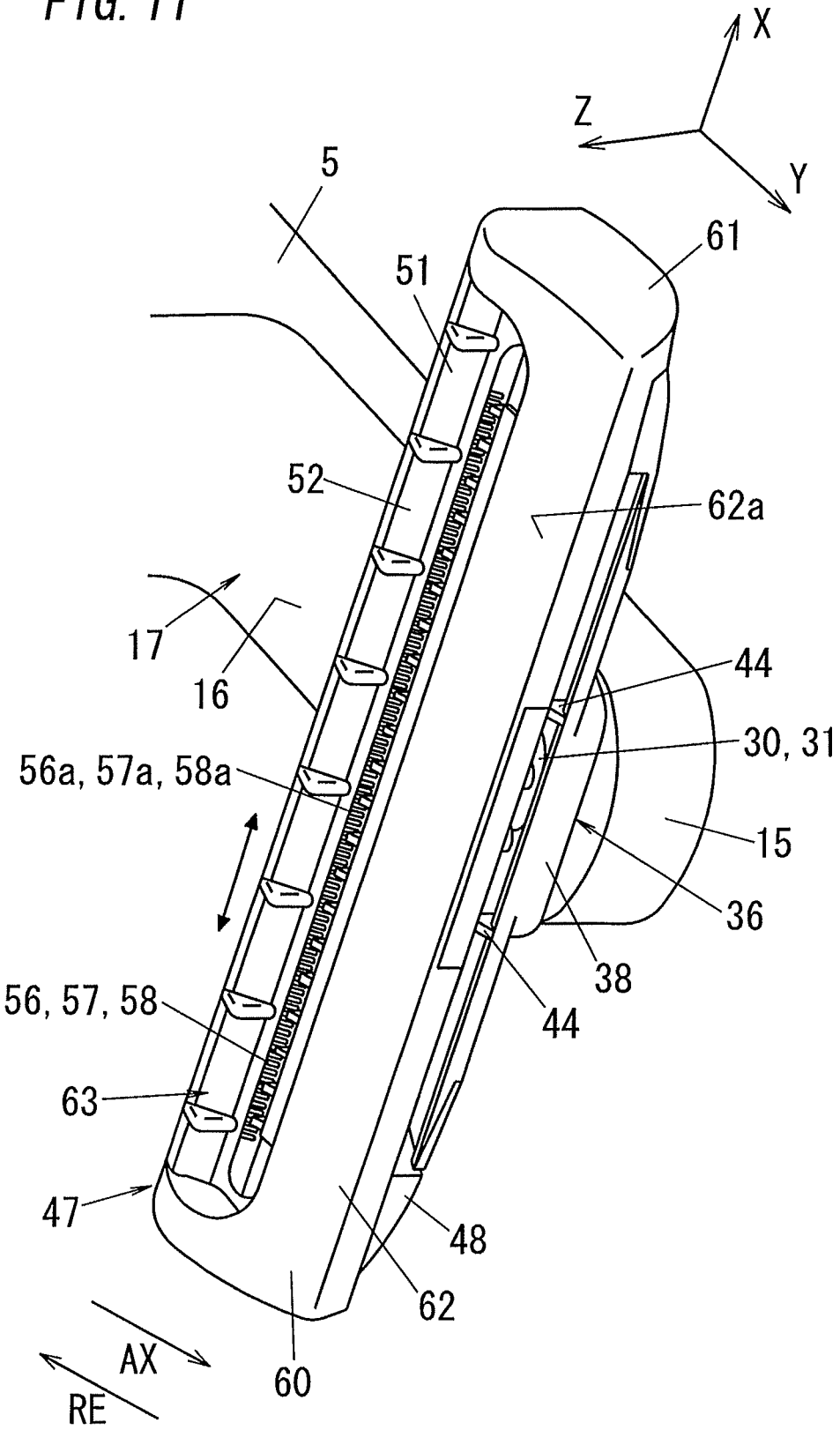
FIG. 11 is an oblique drawing of the head unit in the hair remover according to said Embodiment 1 of the present invention.

Then, as shown in FIG. 3, head unit 47 mainly comprises a blade 56 for removing hair, a holder 51, a driving piece 50, a holder cover 48, a blade cover 60 and a force spring 59. As shown in FIG. 11, a casing of head unit 47 is formed with holder cover 48 and blade cover 60. In addition, head unit 47 is formed into an elongate shape, and is located so that its longitudinal direction is parallel to the longitudinal direction X of turn plate 38. Then, the casing is provided with an opening 63 through which body hair is introduced near the blade 56.

Here, in the following explanation, a direction in head unit 47 along a hair removing direction of blade 56, in which blade 56 removes hair, is defined as a first direction (that is, a width direction of head unit 47 in the present embodiment) of head unit 47, and then a direction in head unit 47 perpendicular to the first direction is defined as a second direction (that is, a longitudinal direction of head unit 47 in the present embodiment) of head unit 47.

As shown in FIG. 7, holder cover 48 is formed into a rectangular frame shape so as to cover short sides and long sides of turn plate 38 from the outside. Then, as shown in FIG. 3, driving piece 50 is located in a center of the frame in the longitudinal direction X. Two supporting platforms 41, 41 are located in both side of driving piece 50. Then, a driving guide 49 is provided between a location space of driving piece 50 and a location space of each supporting platform 41, and limits a driving direction of driving piece 50.

Driving guides 49, 49 limit the driving direction so that driving piece 50 reciprocates in a straight line along the longitudinal direction X that passes through the rotation center of face gear 31. Therefore, when receiving the driving force (eccentric rotation) of drive unit 20 from eccentric section 31*b*, driving piece 50 reciprocates along the longitudinal direction X.

Figure 10A:
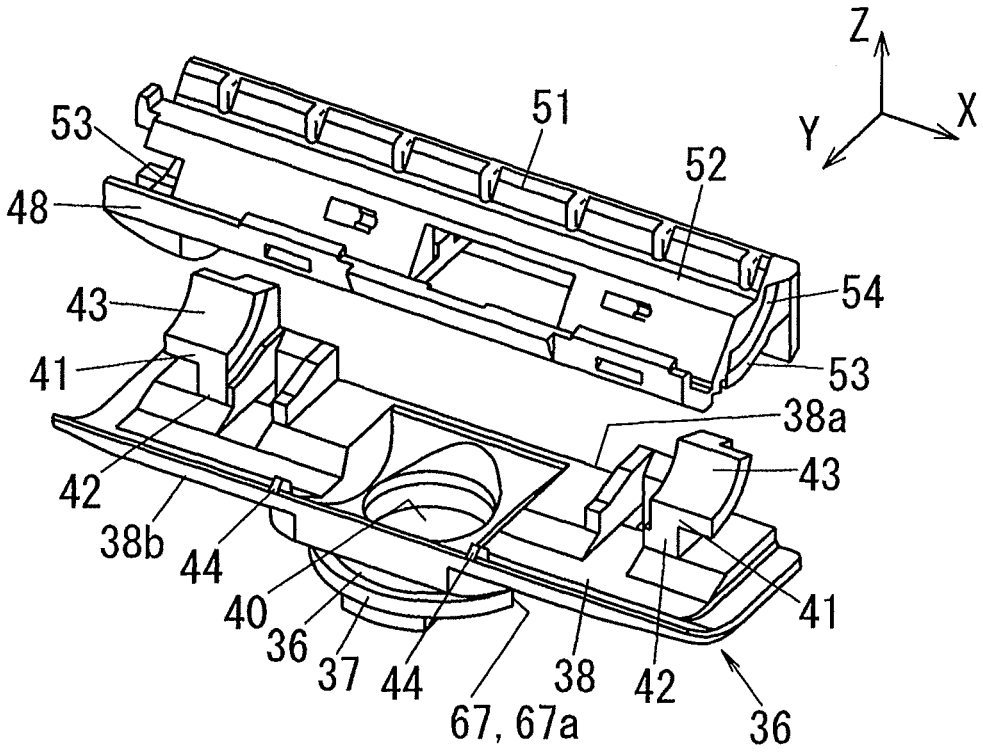
FIG. 10A is an exploded oblique drawing of a swinging mechanical section in the hair remover according to said Embodiment 1 of the present invention.
Figure 10B:
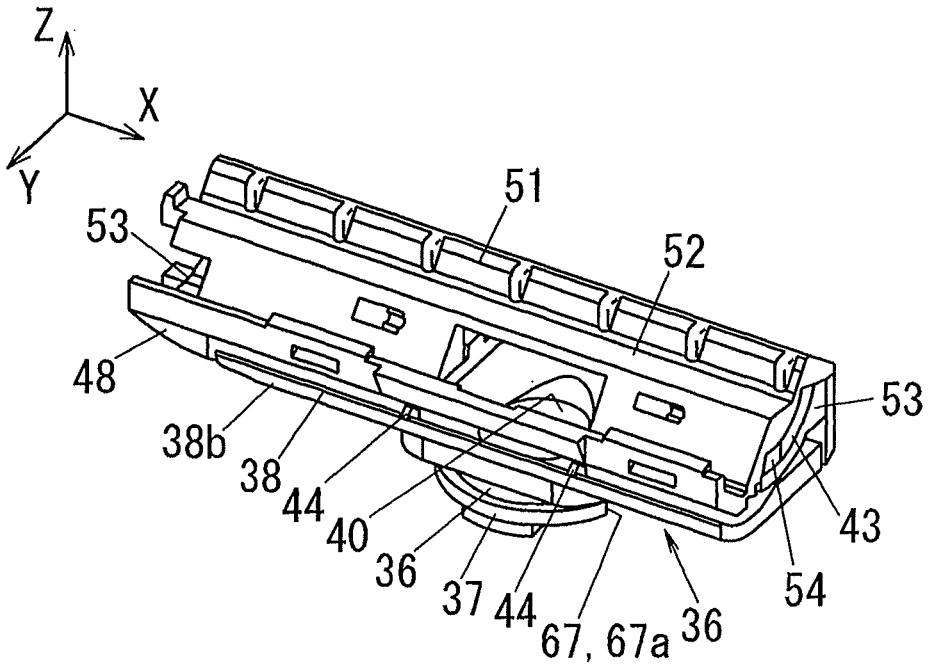
FIG. 10B is an oblique drawing of the swinging mechanical section in a state where a holder has attached to a turn plate of the swinging mechanical section, in the hair remover according to said Embodiment 1 of the present invention.

As shown in FIGS. 10A and 10B, holder 51 is attached in the frame of holder cover 48, and holder cover 48 is supported by turn plate 38 through holder 51, and a surface of holder cover 48 positioned in the side of turn plate 38 contacts with projections 44, 44 located in the second plate surface of turn plate 38. Projections 44, 44 support holder cover 48 from the side of a second long side 38*b*, when head unit 47 is swinging (also including a natural state that will be explained below). Therefore, a load (a pressure) applied from head unit 47 to turn plate 38 is dispersed on supporting platforms 41, 41 and projections 44, 44.

As shown in FIG. 3, holder 51 comprises a holder member 52 holding the blade 56, and holder pieces 53, 53 swingably inserted to groove portions 54, 54 of holder 51, respectively.

In the longitudinal direction X, holder member 52 has a longer size than turn plate 38, and holder cover 48 is attached to holder member 52. Holder member 52 is placed on inclined plates 43, 43 so that its one plate face contacts with inclined plates 43, 43, and is configured to swing along the inclined surfaces of inclined plates 43, 43. In addition, as shown in FIGS. 10A and 10B, 12A and 12B, holder pieces 53, 53 are attached to both ends of holder member 52 in the longitudinal direction X, respectively. Then, groove portion 54 sagging in the width direction Y is provided between holder member 52 and each holder piece 53 in the plate face direction Z.

Each groove portion 54 is formed into an arc shape when viewed from the width direction Y, and its arc has the same radius as the arc of inclined plate 43. A part of inclined plate 43 projecting from base portion 42 in the width direction Y is inserted to groove portion 54. Then, as shown in FIG. 12A, an arc size of groove portion 54 in a circumferential direction is longer than the arc size of inclined plate 43. A difference between these arc sizes determines a swing range of head unit 47. Then, inclined plate 43 is inserted into groove portion 54, and thereby, in the plate face direction Z, inclined plate 43 is sandwiched by holder piece 53 and holder member 52. For this configuration, head unit 47 (holder 51) is retained in turn plate 38 (supporting platform 41).

Then, as shown in FIGS. 7 and 12B, elastic bodies 55, 55 are provided between holder 51 and turn plate 38, and elastically applies energy to head unit 47 along the width direction Y. The swinging mechanical section mainly comprises: elastic bodies 55, 55; supporting platforms 41, 41 having inclined plates 43, 43; holder 51; and driving guides 49, 49 projecting.

Figure 13A:
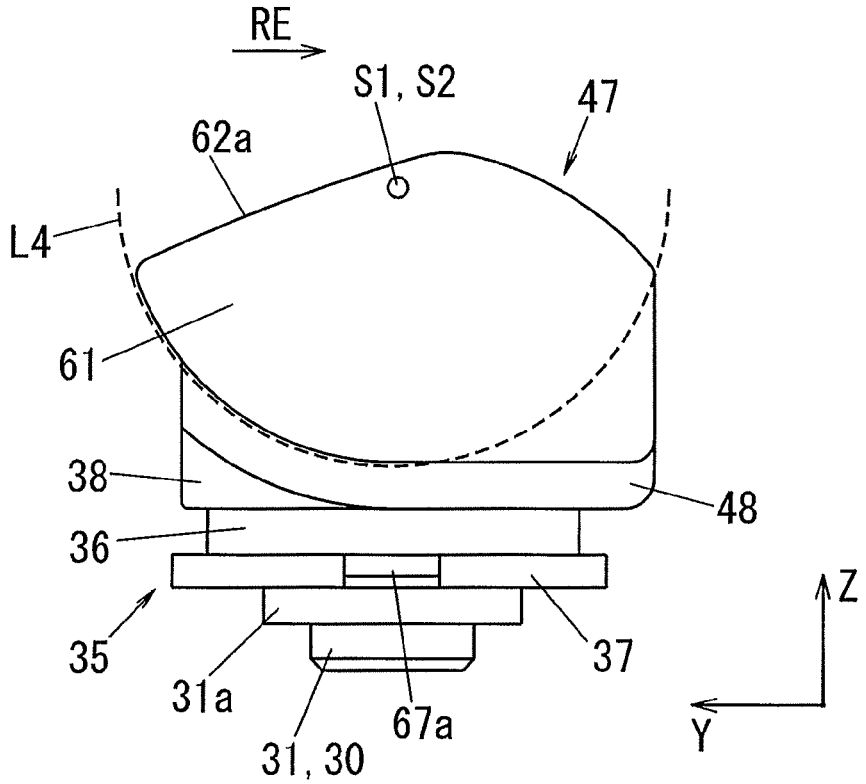
FIG. 13A is a drawing for explaining the swinging mechanical section being in the natural state, in the hair remover according to said Embodiment 1 of the present invention.
Figure 13B:
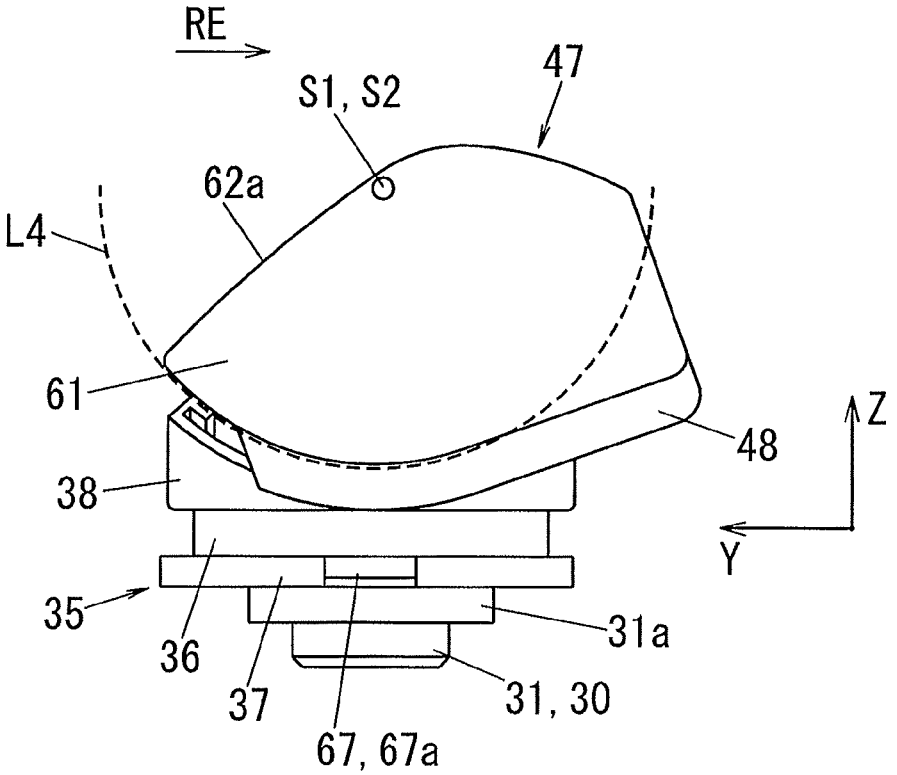
FIG. 13B is a drawing for explaining the swinging mechanical section being in a swinging state, in the hair remover according to said Embodiment 1 of the present invention.

That is, as shown in FIGS. 13A and 13B, in the hair remover of the present embodiment, the swinging mechanical section is located between head unit 47 and turn plate 38. Then, head unit 47 is supported in extension portion 15 through rotating mechanical section 35. For this reason, head unit 47 retains a swingable state, and furthermore can rotate with respect to extension portion 15.

In addition, as shown in FIG. 3, each elastic body 55 is located near the side of output hole 40 with respect to supporting platform 41, and for instance, comprises an urging spring 55*a* for the swing. Then, as shown in FIG. 12B, each elastic body 55 elastically applies energy to head unit 47 in a direction from first long side 38*a* to the opposite second long side 38*b*.

For this reason, as shown in FIGS. 13A and 13B, head unit 47 is configured to elastically swing while being biased to first long side 38*a* through elastic bodies 55, 55. Then, because head unit 47 is biased to second long side 38*b* on the turn plate 38, one end of each inclined plate 43 positioned in the side of first long side 38*a* contacts with one end of the arc of groove portion 54, as shown in FIG. 12A, and then in the present embodiment, such a state is called a natural state of head unit 47, and head unit 47 is not swinging. Hereinafter, unless otherwise noted, head unit 47, being in the natural state as shown in FIG. 13A, will be explained.

As shown in FIG. 3, blade 56 comprises a plate-like fixed blade 57 having a comb-shaped blade (so-called a sinking comb 57*a*) located on a straight line along the longitudinal direction X, and a plate-like movable blade 58 having a comb-shaped blade (so-called a sinking comb 58*a*) located on a straight line along the longitudinal direction X. Then, as shown in FIGS. 11, 12A and 12B, blade 56 is located in the side of second long side 38*b* with respect to the rotation center of output member 30 so that a tip of its blade (sinking comb 56*a*) faces the side of first long side 38*a*.

Fixed blade 57 is fixed to holder member 52. Then, the shaft center S2 of the swing of head unit 47 is positioned on a straight line (a straight line along the tip of the blade) in which a plurality of sinking combs 57*a* in fixed blade 57 are arranged. For this reason, in regard to a tip of fixed blade 57, the amount projecting from turn plate 38 in the plate face direction Z and the position in the width direction Y are not almost changed, when head unit 47 swings.

Movable blade 58 is located along fixed blade 57 so as to override fixed blade 57, and is elastically biased to the side of fixed blade 57 through force spring 59. Then, movable blade 58 receives the driving force from driving piece 50, and reciprocates with respect to fixed blade 57 along the longitudinal direction X in association with the reciprocating of driving piece 50.

In this way, blade 56 is configured to shear body hair while inserting the hair between sinking combs 57*a* in fixed blade 57 and sinking combs 58*a* in movable blade 58 reciprocating, and is so-called a trimmer blade. Then, because sinking comb 56*a* (57*a*, 58*a*) is arranged in the longitudinal direction X, the hair remover has a cutting width along the longitudinal direction X (the second direction of head unit 47), in a region for shearing the hair.

Furthermore, head unit 47 is configured to introduce hair into blade 56 and to shear the hair, by means of moving in a direction from second long side 38*b* to first long side 38*a* along the width direction Y in a state where a tip of its blade contacts with a biological surface. Hereinafter, the direction from second long side 38*b* to first long side 38*a* along the width direction Y will be described as a hair removing direction RE (corresponding with the first direction of head unit 47), and the side of the first long side 38*a* will be described as a front, and the side of the second long side 38*b* will be described as a rearward. That is, for instance, in the hair removing direction RE, blade 56 is provided in its front with the tip of the blade, and then elastic body 55 (urging spring 55*a*) is biased rearward.

As shown in FIG. 11, blade cover 60 mainly comprises: a blade cover section 62 that covers blade 56 from the side of movable blade 58 (that is, from rearward in the hair removing direction RE); and a side cover section 61 that covers both ends of holder cover 48, both ends of holder 51, and both ends of blade 56, in the longitudinal direction X. Side cover section 61 is integrally formed in both ends of blade cover section 62 in the longitudinal direction X, and is secured to holder cover 48 and holder 51.

Blade cover section 62 is formed in the side of first long side 38*a* with a recess sagging in the width direction Y (that is, sagging rearward in the hair removing direction RE). The recess is formed so as to have a larger size than the cutting width in the longitudinal direction. Then, opening 63 through which the tip of blade 56 is exposed is located between this recess and holder member 52 in the width direction Y, and introduces body hair into sinking comb 56*a* of blade 56. Then, because sinking comb 56*a* of blade 56 (the tip) is exposed through opening 63, the shaft center S2 is located within opening 63 when viewed from the plate face direction Z.

Then, blade cover section 62 is provided with a flat outer surface 62*a* along the longitudinal direction X. This outer surface 62*a* functions as a skin contact surface for contacting with a biological surface when body hair is removed. Then, the skin contact surface is located in the side of second long side 38*b* with respect to opening 63 (that is, is located rearward in the hair removing direction RE), and then is located behind the shaft center S2 of the swing and the center of output hole 40 (the rotation center of face gear 31), with respect to the hair removing direction RE (the first direction of head unit 47).

Figure 14:
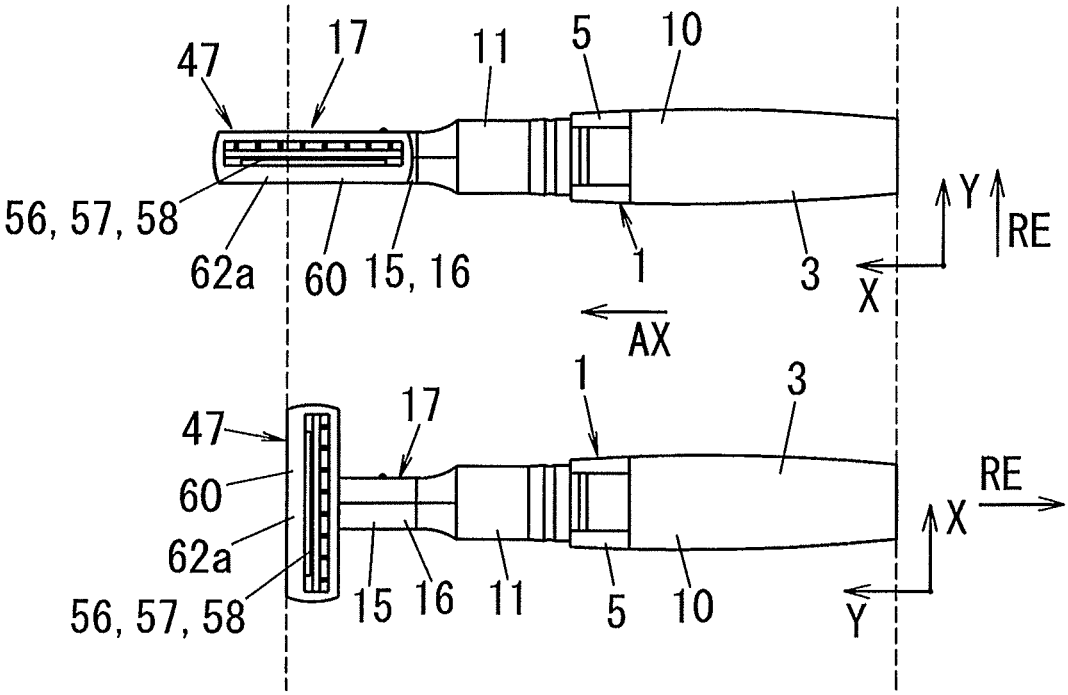
FIG. 14 is a drawing for explaining a total length of the hair remover according to said Embodiment 1 of the present invention.

Incidentally, in regard to the casing of head unit 47, half of its total length in the longitudinal direction X (a length of head unit 47 in the second direction) is shorter than a distance from the rotation center of face gear 31 to one end of small diameter section 11. Therefore, head unit 47 does not interfere with small diameter section 11 when rotating. Then, as shown in FIGS. 5 and 14, the second direction (the longitudinal direction X) of head unit 47 can be positioned so as to be almost parallel to the extension direction Ax, and furthermore can be also rotated 360 degrees. Then, output member 30 is located in output hole 40 so that its axis corresponds with the rotation center of rotating mechanical section 35, and thereby even if head unit 47 is located in any direction (a position after the rotation), the driving force of drive unit 20 can be transferred to head unit 47, and blade 56 can be driven.

Then, as shown in FIG. 14, when the second direction (the longitudinal direction X) is positioned so as to be almost parallel to the extension direction Ax, the total length of the hair remover becomes longer than a total length of the hair remover in a state where the second direction is positioned so as to be almost perpendicular to the extension direction Ax. For this reason, rotating mechanical section 35 also functions as a variability mechanical section that can change the total length, by means of rotating head unit 47 with respect to main unit 1.

Hereinafter, a state where the second direction of head unit 47 is almost parallel to the extension direction Ax, that is, a position where the hair remover has an I-shaped appearance when viewed from the plate face direction Z, will be described as a first position. Then, a state where the second direction of head unit 47 is almost perpendicular to the extension direction Ax of main unit 1, that is, a position where the hair remover has a T-shaped appearance when viewed from the plate face direction Z, will be described as a second position. These first and second positions are defined as one standard of a position of the hair remover.

Figure 15A:
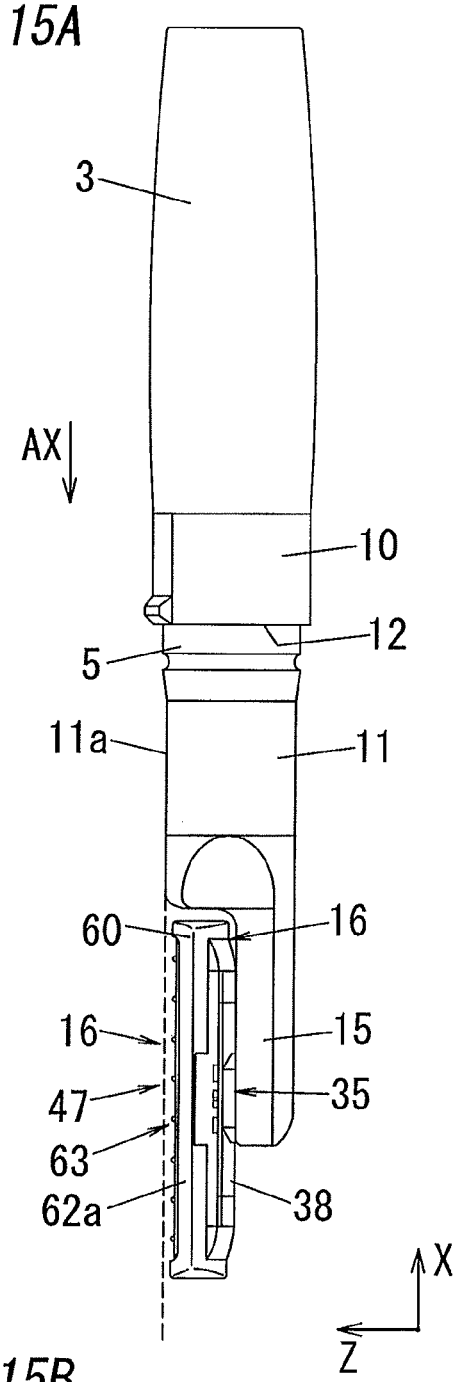
FIG. 15A is a side view of the main unit and the head unit in the hair remover according to said Embodiment 1 of the present invention.
Figure 15B:
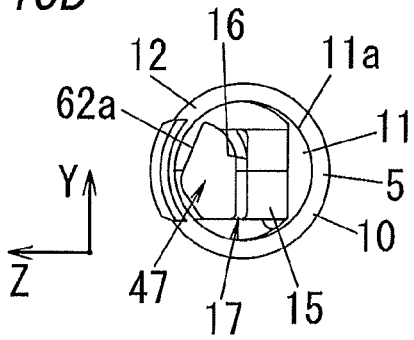
FIG. 15B is a drawing of the main unit and the head unit, viewed from an extension direction, in the hair remover according to said Embodiment 1 of the present invention.

Then, as shown in FIGS. 15A and 15B, in the first position, extension portion 15 and head unit 47 are located so as to be almost flush with an outer periphery 11*a* of small diameter section 11 or so as not to extend beyond the outer periphery 11*a* when viewed from the extension direction Ax, and that is, the hair remover is configured so that extension portion 15 and head unit 47 do not project from the outer periphery 11*a* to the outside along a radial direction.

Figure 16:
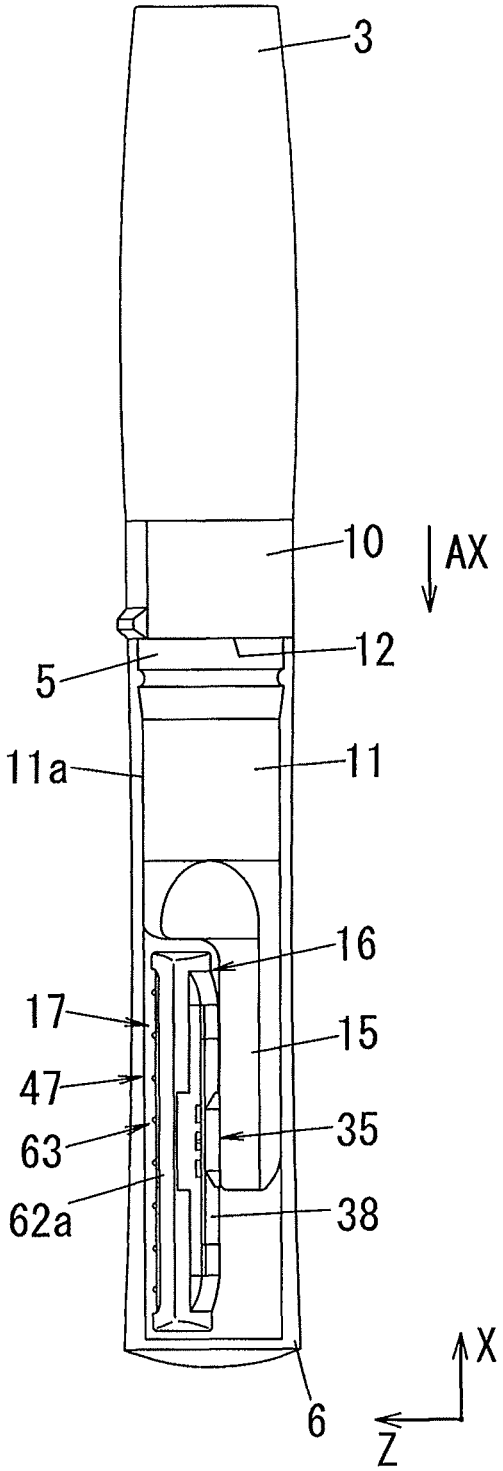
FIG. 16 is a side view of the hair remover in a state where a cap has attached, in the hair remover according to said Embodiment 1 of the present invention, and partially includes a transparent view.

For this reason, as shown in FIG. 16, in this state of the hair remover, cap 6 can be attached so as to cover casings of extension portion 15 and head unit 47, and the outer periphery 11*a* of small diameter section 11. This cap 6 is formed into a cylinder shape having the bottom, and a radius of its outer periphery is almost equal to a radius of gripper 10. Then, extension portion 15, head unit 47 and small diameter section 11 are stored in cap 6. Then, cap 6 is attached to main unit 1 so that an axis of cap 6 almost corresponds with an axis of gripper 10. At this time, one end of cap 6 in an opening side fits in the difference 12 in level provided between small diameter section 11 and gripper 10, and thereby cap 6 is held in housing 5.

Then, as shown in FIG. 6, the hair remover comprises a lock portion that regulates a stopping position of head unit 47 (a direction of head unit 47) when head unit 47 is rotated through rotating mechanical section 35. As shown in FIG. 4, the lock portion mainly comprises a handle member 69, a spring 68 and a recess 67 (see FIG. 7). Spring 68 is located within extension portion 15, and elastically applies energy to handle member 69 in a direction that separates from main unit 1 along the extension direction Ax.

As shown in FIG. 7, recess 67 is formed into a rectangular shape when viewed from the plate face direction Z, and is formed in flange 37 so as to sag to the inside along the radial direction. Then, in the present embodiment, three recesses 67 are provided in flange 37, and are located at intervals of 90 degrees along a circumferential direction of the rotation. More specifically, two recesses 67, 67 (first recesses 67*a*, 67*a*) are located on a straight line along the longitudinal direction X passing through the rotation center of flange 37 so as to have own back toward each other, and one recess 67 (a second recess 67*b*) is located on a straight line along the width direction Y passing through the rotation center of flange 37.

As shown in FIG. 6, handle member 69 is located within extension portion 15, and is biased to the tip side of extension portion 15 through spring 68, and is slidable in the extension direction Ax. Then, as shown in FIG. 4, handle member 69 is provided with a stop piece 69*a* and an operation piece 69*b*. Stop piece 69*a* projects in the extension direction Ax, and selectively fits in one of three recesses 67. Operation piece 69*b* is provided for causing handle member 69 to slide to the side of gripper 10 against an added force of spring 68. Then, Operation piece 69*b* is exposed on the outside through an opening provided in extension portion 15, and the exposed part is operated.

A projecting tip of stop piece 69*a* is formed into a rectangular shape so as to fit in recess 67. A rotating operation of rotating part 36 is controlled through fitting in recess 67, and thereby the stopping position of head unit 47 (the direction of head unit 47) is controlled. Then, when handle member 69 is slid to the side of small diameter section 11 through operating of the operation piece 69*b* and the tip of stop piece 69*a* is separated from the recess 67, the rotating operation is released from the control.

In addition, when stop piece 69*a* fits in one of first recesses 67*a*, 67*a*, head unit 47 is held in the first position where cap 6 can be attached. Also, when stop piece 69*a* fits in the other of first recesses 67*a*. 67*a*, head unit 47 is held in the first position. However, at this time, front and back of the hair removing direction RE (a direction of the tip of the blade) switch positions with each other. Then, when stop piece 69*a* fits in second recess 67*b*, head unit 47 is held in the second position, and gripper 10 is located in the front side of the hair removing direction RE.

As described above, in the hair remover of the present embodiment, when head unit 47 is rotated in a circumferential direction of rotating part 36 through rotating mechanical section 35, the second direction of head unit 47 can be changed with respect to the extension direction Ax, as shown in FIG. 14. Then, as shown in FIGS. 8 and 9, rotating mechanical section 35 is provided with output hole 40, of which the axis almost corresponds with the rotation center of output member 30, and which outputs the driving force of drive unit 20 into head unit 47. Therefore, even if a direction of head unit 47 is changed, the driving force can be transferred (outputted) to head unit 47.

For this reason, the hair removing direction RE (a direction of the tip of the blade) can be changed with respect to main unit 1, and the hair remover can transfer the driving force of drive unit 20 to head unit 47 and can perform the removing motion, regardless of the stopping position of head unit 47. Therefore, when removing body hair growing on an area having irregularities around, such as a biological surface of a base of arm or leg, the hair remover can switch (change) to a position where main unit 1 (gripper 10) or hand grasping main unit 1 hardly interferes in the irregularities, and can performs the removing motion. Then, because the hair remover performs the removing motion in the position where main unit 1 or the like hardly interferes in the irregularities, the hair remover can reduce the possibility that body hair is insufficiently shaved due to the interference, and can improve the convenience.

Then, the rotation center of rotating mechanical section 35 and the rotation center of output member 30 are configured to almost correspond with each other, and thereby the hair remover is configured so that a relative position of turn plate 38 (the rotation center of rotating mechanical section 35) and output member 30 (the rotation center of face gear 31) do not change upon rotation of head unit 47. Therefore, even if head unit 47 is stopping in any position, basic characteristic of the driving force transferred to head unit 47, such as an amplitude of driving piece 50, a rotating speed of eccentric section 31*b* or the like, do not change, and then, movable blade 58 can be driven stably in the same condition.

Then, rotating mechanical section 35 has turn plate 38 that supports head unit 47, and thereby the swinging mechanical section configured to swing head unit 47 with respect to turn plate 38 can be provided between head unit 47 and turn plate 38, and furthermore can be located so as to hardly interfere in rotating mechanical section 35. Therefore, the swing of head unit 47 makes it easier for blade 56 to come close to a biological surface, and head unit 47 contacts with the biological surface more smoothly, and then hair can be introduced into blade 56 more easily.

Then, because the swinging mechanical section is configured to swing around an imaginary shaft center S2, there is no need to have a shaft center really existing as a member. Therefore, the hair remover can avoid, more easily, the possibility that a size of head unit 47 becomes larger so that such a member does not interfere in the other configuration members in head unit 47. Furthermore, the hair remover can easily have a larger swingable radius, compared with a hair remover having such a member.

In addition, shaft center S2 is located along the tip of fixed blade 57. Therefore, when the head unit 47 is swinging, the tip does not move. Then, a distance (a length of an introduced hair) from the biological surface to the tip of the blade hardly changes. For this reason, the shaving performance, such as a cutting height influenced by a distance to the tip of the blade, hardly changes through the swing, and thus the hair remover having the stable shaving performance can be provided easily.

Furthermore, the skin contact surface is provided behind the tip of blade 56 with respect to the hair removing direction RE (the first direction of head unit 47). As a result, when the skin contact surface is pressed against the biological surface upon removing hair, head unit 47 swings and easily follows the skin. This makes it easier for blade 56 to come close to the skin, and then hair can be cut in a location near the biological surface, and thus the hair remover improving the shaving performance can be provided easily.

Then, because gear block 25 transferring the driving force from rotation shaft 22 to output member 30 is located at some distance from rotation shaft 22, toward the outside along a radial direction, output member 30 can be located on an extended line of rotation shaft 22, and then the hair remover can reduce the amount projecting to the outside along a radial direction of output member 30. For this reason, the hair remover can easily reduce the amounts of head unit 47 and drive transmission unit 23 projecting to the outside along a radial direction with respect to main unit 1, and, in the first position, can be easily configured so that head unit 47 and drive transmission unit 23 hardly project beyond small diameter section 11 to the outside along the radial direction. Then, this configuration causes the hair remover to have a compact configuration (that is, to be downsized). As a result, the hair remover can easily improve the convenience upon removing hair, and can easily prevent from increasing in the size of cap 6. Furthermore, the prevention of cap 6 causes the hair remover to have a compact configuration, in a state where cap 6 has attached (that is, in a non-use state, such as a time when the hair remover is carried). Therefore, the hair remover can easily improve the convenience in the time when the hair remover is carried.

Then, extension portion 15 is placed at some distance from rotation shaft 22, toward the outside along the radial direction, and recess 17 is provided in the rotation position of head unit 47. Therefore, in the hair remover, a dead space hardly generates and the amount of head unit 47 projecting can be easily reduced, compared with a hair remover that has extension portion 15 provided on an extended line of rotation shaft 22. For this reason, the hair remover can be easily configured so that, in the first position, head unit 47 and extension portion 15 hardly project beyond small diameter section 11 to the outside along a radial direction, and then can easily have a compact configuration.

In addition, when viewed from the extension direction Ax, head unit 47, extension portion 15 and drive transmission unit 23 do not project beyond small diameter section 11 to the outside along a radial direction in the first position. Therefore, an inner diameter of cap 6 can be set so as to be almost equal to an outer diameter of small diameter section 11. For this reason, the diameter of cap 6 is hardly influenced by the amount of head unit 47 projecting from extension portion 15 and the amount of extension portion 15 projecting, and then the hair remover can easily prevent from increasing in the size of cap 6 and can easily have a compact configuration. Then, because the rotating mechanical section 35 also functions as the variability mechanical section, the total length of the hair remover in the extension direction Ax can be changed through switching from the first position to the second position or the like in accordance with an area or its shape of a biological surface in which the hair removing is desired. Therefore, when removing hair, the hair remover or hand grasping it hardly interferes in the irregularities, through switching (changing) the total length. Then, the hair remover can reduce the possibility that body hair is insufficiently shaved due to the interference.

(Embodiment 2)

A hair remover of the present embodiment also comprises a rotating mechanical section 35 and a swinging mechanical section. However, the hair remover of the present embodiment is different from that of Embodiment 1 in the configuration of drive unit 20.

Figure 17:
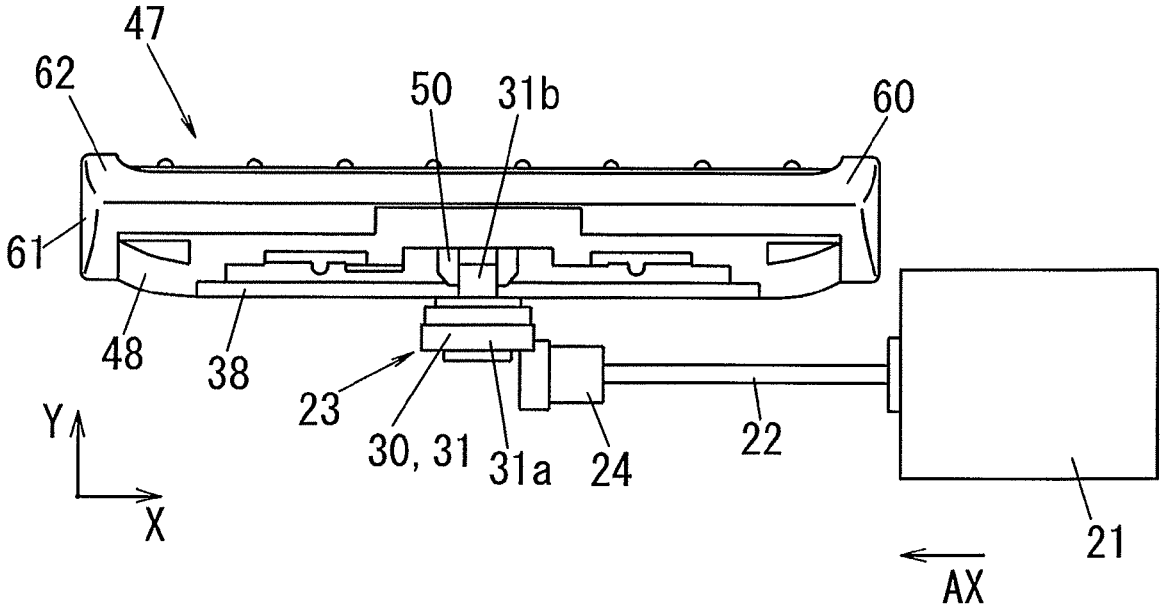
FIG. 17 is a side view of a drive unit and a head unit in a hair remover according to an Embodiment 2 of the present invention.

More specifically, as shown in FIG. 17, rotation shaft 22 of motor 21 is located so as to project within extension portion 15, and then pinion gear 24 engages with gear 31*a* of face gear 31 directly so as to be almost perpendicular to the rotation center.

As described above, in the hair remover of the present embodiment, transmission of the driving force through engagement of gear members is performed only in one location within drive unit 20. Therefore, drive unit 20 can have a simple configuration, and such a configuration can reduce loss of the driving force caused by engagement of gears or the like within drive transmission unit 23.

In addition, although the present invention has been described with reference to certain preferred embodiments, numerous modifications and variations can be made by those skilled in the art without departing from the true spirit and scope of this invention, namely claims. For instance, base portion 42 may be formed so as to have the same width as inclined plate 43, and a second groove portion may be provided between those in the plate face direction Z, and holder piece 53 may be inserted into the second groove portion, and thereby holder 51 may be retained in turn plate 38. Further, for instance, the hair remover may comprise a cord or the like for connecting to a commercial power source, instead of having an electric source built in. Then, in the configuration of Embodiment 1, gear block 25 may comprise a plurality of spur gears, and a caterpillar track, such as a belt, may be used instead of transmission shaft 26.

The invention claimed is:

1. A hair remover comprising:

a main unit having a gripper;

a head unit having a movable blade and a fixed blade for removing hair;

a motor;

a drive transmission unit configured to transfer a rotation driving force of said motor to reciprocate said movable blade; and a rotating mechanical section configured to rotatably support said head unit with respect to said main unit, wherein said main unit is provided in one end thereof with an extension portion said main unit and said extension portion having longitudinal axes that are in parallel to each other, wherein said extension portion is offset with regard to the longitudinal axis of said main unit to define a recess which houses said head unit, said extension portion being provided with said rotating mechanical section, said rotating mechanical section being configured to support said head unit to be capable of switching between a state of a first position where a longitudinal axis of said head unit is parallel to the longitudinal axis of said main unit so that said hair remover has an I-shaped appearance and a state of a second position where the longitudinal axis of said head unit is perpendicular to the longitudinal axis of said main unit so that said hair remover has a T-shaped appearance, and wherein said drive transmission unit is configured to transfer the rotation driving force of said motor to said movable blade to reciprocate said movable blade in said states of said first and second positions.

2. The hair remover as claimed in claim 1, wherein said rotating mechanical section is configured to support said head unit so as to be capable of being rotated 360 degrees with respect to said main unit to perform the switching between said states of said first and second positions.

3. The hair remover as claimed in claim 2, wherein said drive transmission unit comprises: a face gear; a shaft member that is fixed in said extension portion so as to rotatably support said face gear; and a pinion gear that is provided at one end of said rotation shaft of said motor, wherein said shaft member is placed so that an axis of said shaft member is perpendicular to an axis of a rotation shaft of said motor, and wherein said pinion gear is configured to directly engage with said face gear to rotate said face gear.

4. The hair remover as claimed in claim 3, wherein said rotating mechanical section comprises a turn plate that is rotatably attached at said extension portion to support said head unit, said turn plate being provided with an output hole that is formed as a through hole along the axis of said shaft member, and wherein said face gear comprises an eccentric section that is configured to project toward said head unit through said output hole to transfer the rotation driving force of said motor to said head unit.

5. The hair remover as claimed in claim 2, wherein said drive transmission unit comprises: a face gear; a shaft member that is fixed in said extension portion so as to rotatably support said face gear; a pinion gear that is provided at one end of said rotation shaft of said motor; a transmission shaft; and two gears, wherein said shaft member is placed so that an axis of said shaft member is perpendicular to an axis of a rotation shaft of said motor, and wherein the pinion gear is configured to indirectly engage with said face gear via said transmission shaft and said two gears to rotate said face gear.

6. The hair remover as claimed in claim 5, wherein said rotating mechanical section comprises a turn plate that is rotatably attached at said extension portion to support said head unit, said turn plate being provided with an output hole that is formed as a through hole along the axis of said shaft member, and wherein said face gear comprises an eccentric section that is configured to project toward said head unit through said output hole to transfer the rotation driving force of said motor to said head unit.

7. The hair remover as claimed in claim 1, wherein said drive transmission unit comprises: a face gear; a shaft member that is fixed in said extension portion so as to rotatably support said face gear; and a pinion gear that is provided at one end of said rotation shaft of said motor, and wherein said shaft member is placed so that an axis of said shaft member is perpendicular to an axis of a rotation shaft of said motor, and wherein said pinion gear is configured to directly engage with said face gear to rotate said face gear.

8. The hair remover as claimed in claim 7, wherein said rotating mechanical section comprises a turn plate that is rotatably attached at said extension portion to support said head unit, said turn plate being provided with an output hole that is formed as a through hole along the axis of said shaft member, and wherein said face gear comprises an eccentric section that is configured to project toward said head unit through said output hole to transfer the rotation driving force of said motor to said head unit.

9. The hair remover as claimed in claim 1, wherein said drive transmission unit comprises: a face gear; a shaft member that is fixed in said extension portion so as to rotatably support said face gear; a pinion gear that is provided at one end of said rotation shaft of said motor; a transmission shaft; and two gears, wherein said shaft member is placed so that an axis of said shaft member is perpendicular to an axis of a rotation shaft of said motor, and wherein the pinion gear is configured to indirectly engage with said face gear via said transmission shaft and said two gears to rotate said face gear.

10. The hair remover as claimed in claim 9, wherein said rotating mechanical section comprises a turn plate that rotatably attached at said extension portion to support said head unit, said turn plate being provided with an output hole that is formed as a through hole along the axis of said shaft member, and wherein said face gear comprises an eccentric section that is configured to project toward said head unit through said output hole to transfer the rotation driving force of said head unit.

* * * * *